US005571021A

United States Patent [19]

Kawabe et al.

[11] Patent Number: 5,571,021

[45] Date of Patent: Nov. 5, 1996

[54] EMULATOR PROBE

[75] Inventors: Hideki Kawabe; Toshihiko Sugahara, both of Hyogo, Japan

[73] Assignees: Mitsubishi Electric Semiconductor Software Co., Ltd., Itami; Mitsubishi Denki Kabushiki Kaisha, Tokyo, both of Japan

[21] Appl. No.: 422,902

[22] Filed: Apr. 17, 1995

[30] Foreign Application Priority Data

Nov. 24, 1994 [JP] Japan ..... 6-289533

[51] Int. Cl.[6] ..... H01R 23/72; H01R 9/09

[52] U.S. Cl. ..... 439/71; 439/70; 439/482; 439/912

[58] Field of Search ..... 439/67, 70, 71, 439/83, 482, 912, 912.1, 72, 73

[56] References Cited

U.S. PATENT DOCUMENTS

| | | | |
|---|---|---|---|
| 4,536,955 | 8/1985 | Gudgeon | 439/83 |
| 4,538,864 | 9/1985 | Ichimura | 439/71 |
| 4,648,666 | 3/1987 | Levell | 439/71 |
| 4,655,516 | 4/1987 | Shaffer et al. | 439/67 |
| 4,833,404 | 5/1989 | Meyer et al. | 439/912.1 |
| 4,997,377 | 3/1991 | Goto et al. | 439/67 |
| 5,176,524 | 1/1993 | Mizuno et al. | 439/73 |
| 5,205,741 | 4/1993 | Steen et al. | 439/70 |
| 5,213,512 | 5/1993 | Campbell et al. | 439/67 |
| 5,292,266 | 3/1994 | Matsuoka | 439/70 |

FOREIGN PATENT DOCUMENTS

| | | | |
|---|---|---|---|
| 276577 | 11/1989 | Japan | 439/71 |
| 106087 | 4/1990 | Japan | 439/70 |

*Primary Examiner*—Gary E. Elkins

*Attorney, Agent, or Firm*—Oblon, Spivak, McClelland, Maier, & Neustadt, P.C.

[57] ABSTRACT

An emulator probe comprising a direction changing board 10 having a first connector 11 to be coupled to a relaying connector 9 set on one surface thereof and a second connector 12 set on the other surface thereof such that the direction of setting of the same is different from the direction of setting of the first connector 11 and adapted such that soldering to a microcomputer mounting foot pattern 3 is achieved not through a pin terminal but through a semicircular edge portion of a semicircular through hole 8*a* formed in the peripheral surface of a semicircular through-hole board 8, and therefore, the emulator can be mounted on a user target board 1 easily without the need to deform the emulator cable and, further, the area occupied by the microcomputer mounting foot pattern can be decreased.

4 Claims, 4 Drawing Sheets

EMULATOR PROBE

BACKGROUND OF THE INVENTION

1. Field of the Invention

The present invention relates to an emulator probe of an in-circuit emulator for supporting program development of a microcomputer.

2. Description of the Prior Art

FIG. 1 is a perspective view showing a prior art emulator probe. In FIG. 1, reference numeral 1 denotes a user target board on which a microcomputer 2 after completion of program development is mounted, 3 denotes a foot pattern provided on the user target board 1 for mounting the microcomputer, and 4 denotes a Lead Chip Carrier (LCC) socket having, on its under side, pin terminals 4*a* to be connected with the microcomputer mounting foot pattern 3 by soldering and having a microcomputer insertion portion 4*b* into which either the microcomputer 2 or a connector dedicated to probe 7 is inserted. On the microcomputer insertion portion 4*b* of the LCC socket 4, there are provided terminals electrically connected with the pin terminals 4*a*. Reference numeral 5 denotes a stiffening plate attached to the end of an emulator cable 6 and reference numeral 7 denotes a connector dedicated to probe provided on the under side of the stiffening plate 5 and adapted to be inserted into the microcomputer insertion portion 4*b* of the LCC socket 4 for exchanging electric signals between the emulator body (not shown) and the user target board 1.

Functioning of the above will be described below.

In the development of a program for a microcomputer 2, it is generally required to debug the designed program. Therefore, before the microcomputer 2 is directly mounted on the user target board 1, the emulator is mounted, instead of the microcomputer 2, on the user target board 1 to debug the designed program.

However, the emulator is used over again every time a program is designed. Therefore, in order to mount the connector dedicated to probe 7, which is connected with the emulator, on the user target board 1 without soldering it directly to the user target board 1, it is practiced to solder an LCC socket 4, instead of the connector dedicated to probe 7, to the user target board 1 and insert the connector dedicated to probe 7 into the microcomputer insertion portion 4*b* to thereby achieve the mounting of the emulator on the user target board 1.

Since the LCC socket 4 and the connector dedicated to probe 7 are particular to each emulator, they are generally produced by resin forming and hence their producing cost becomes considerably high.

Since prior-art emulator probes are structured as described above, the drawing direction of the emulator cable 6 is limited to one direction. Hence, when there is mounted a tall part in the vicinity of the LCC socket 4 in the direction in which the cable is led out, there arises a problem in that the connector dedicated to probe 7 cannot be inserted into the LCC socket 4 unless the emulator cable 6 is deformed.

Further, when the pin terminals 4*a* of the LCC socket 4 are soldered to the microcomputer mounting foot pattern 3, the pin terminals 4*a* are to be stretched outward in a radiating manner and in parallel with the user target board 1 and hence the microcomputer mounting foot pattern 3 must be provided extended outward from the LCC socket 4 by the length corresponding to the length of the pin terminals 4*a*. Accordingly, there arises a problem in that the area occupied by the microcomputer mounting foot pattern 3 becomes greater than the area occupied by the LCC socket 4 and, as a result, the packaging density on the user target board 1 is decreased.

SUMMARY OF THE INVENTION

The invention has been made to solve the above mentioned problems. Accordingly, it is an object of the present invention to provide an emulator probe whereby the emulator can be mounted on the user target board easily without deforming the emulator cable and, further, the area occupied by the microcomputer mounting foot pattern can be reduced.

In order to achieve the above mentioned object, the emulator probe according to the present invention is provided with a direction changing board having a first connector to be coupled with a relaying connector set on one surface thereof and a second connector set on the other surface thereof such that the direction of setting of the second connector is different from the direction of setting of the first connector, and adapted such that soldering with a microcomputer mounting foot pattern is achieved not through a pin terminal but through a semicircular edge portion of a semicylindrical conductor forming a semicircular through hole in the peripheral surface of a semicircular through-hole board.

Since the emulator probe according to the present invention is provided with a direction changing board having the first connector to be coupled with the relaying connector set on one surface thereof and the second connector set on the other surface thereof such that the direction of setting of the same is different from the direction of setting of the first connector, the direction in which the emulator cable is led out is not limited to one.

Further, since it is adapted such that soldering to the microcomputer mounting foot pattern is achieved not through the pin terminal but through the semicircular edge portion of the semicylindrical conductor forming the semicircular through hole in the peripheral surface of the semicircular through-hole board, the soldering can be carried out even if the area occupied by the microcomputer mounting foot pattern and the area occupied by the semicircular through-hole board are virtually equal.

The above and further objects and novel features of the invention will be more fully appear from the following description of the preferred embodiments when read in conjunction with the accompanying drawings. It is to be expressly understood, however, that the drawings are for purpose of illustration only and not intended as a definition of the limits of the invention.

DESCRIPTION OF THE PREFERRED EMBODIMENTS

Embodiment 1

An embodiment of the invention will be described below with reference to the accompanying drawings.

Figure 1:
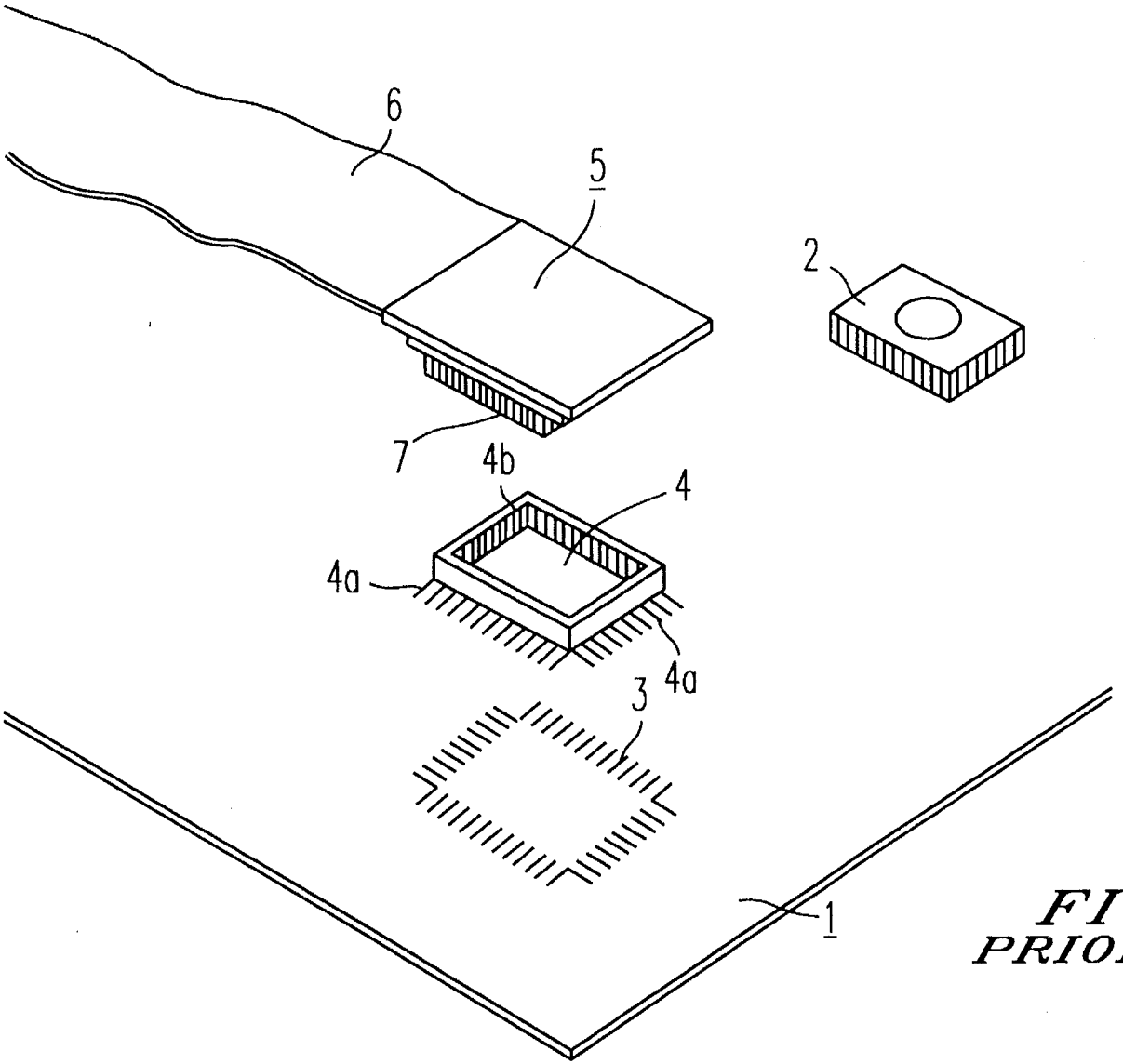
FIG. 1 PRIOR ART
FIG. 1 is a perspective view showing a prior art emulator probe.
Figure 2:
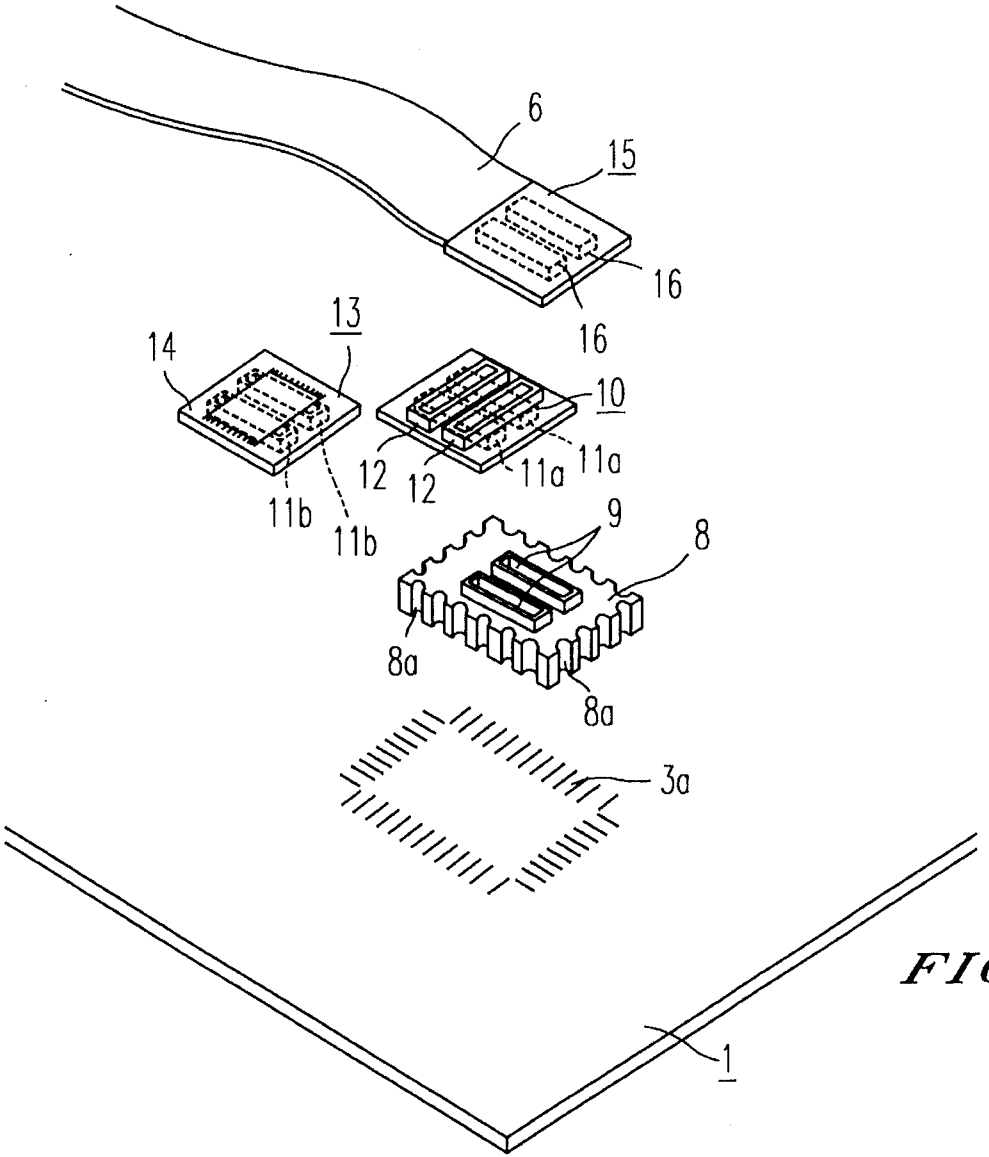
FIG. 2 is a perspective view showing an emulator probe according to an embodiment 1 of the invention.
Figure 3A:
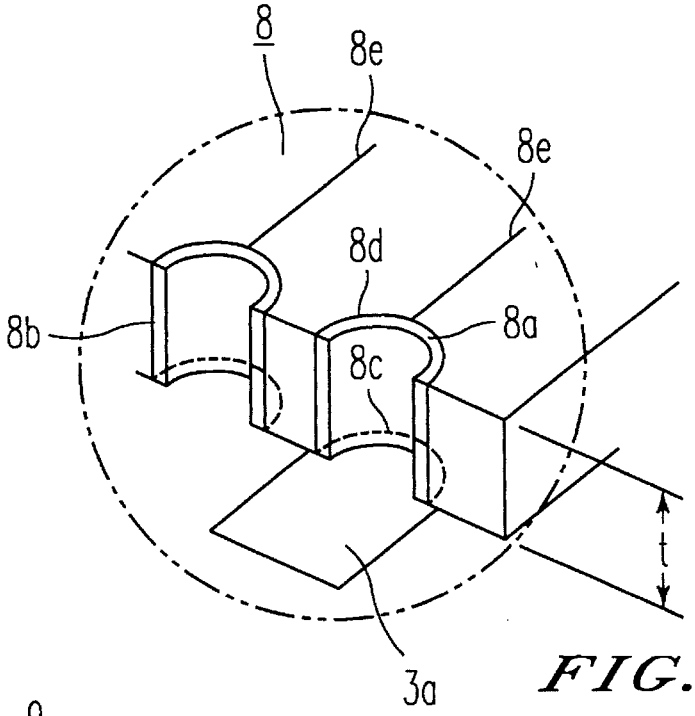
FIG. 3 is an enlarged view in perspective showing a main portion of a semicircular through-hole board 8 in the embodiment 1.
Figure 3B:
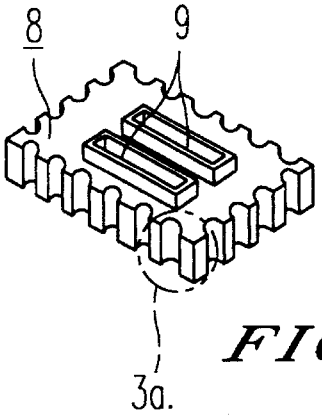

FIG. 2 is a perspective view showing an emulator probe according to an embodiment 1 of the invention and FIG. 3 is an enlarged view in perspective of a portion of FIG. 2. Throughout the drawings, reference numerals like those used for denoting pans of the prior art example will denote like or corresponding parts and therefore description of the same will be omitted.

Referring to FIG. 2 and FIG. 3, reference numeral 8*b* denotes a semicylindrical conductor having a semicircular edge portion 8*c* to be soldered to a microcomputer mounting foot pattern 3*a* provided on the user target board 1 and forming a semicylindrical through hole 8*a*. There is at least one semicylindrical conductor 8*b*. Reference numeral 8 denotes a semicircular through-hole board, having the semicylindrical conductor 8*b* disposed on the peripheral surface thereof such that the semicylindrical through hole 8*a* forms a recess in the peripheral surface. Reference numeral 9 denotes a relaying connector disposed on the semicircular through-hole board 8 and having a terminal electrically connected with the semicylindrical conductor 8*b*. Reference numeral 10 denotes a direction changing board having a first connector 11*a*, electrically coupled with the relaying connector 9, set on the under side thereof and having a second connector 12, electrically connected with the first connector, set on the upper side thereof such that the direction of setting of the same is different from the direction of setting of the first connector 11*a*. Reference numeral 13 denotes a microcomputer mounting board having a first connector 11*b*, electrically coupled to the relaying connector 9, disposed on the under side thereof and having a third connector 14, having a terminal electrically connected with a terminal of the first connector 11*b* and mounting the microcomputer 2 thereon, disposed on the upper side thereof. Reference numeral 15 denotes a cable setting board attached to the end of the emulator cable 6 and having a connector 16 electrically coupled with the second connector 12 on the direction changing board 10.

The semicylindrical conductor 8*b* can be simply formed by having a cylindrical conductor in ordinary use for forming through holes cut in two along its center axis.

Functioning of the above embodiment will be described below.

First, in the emulator probe of the first embodiment, the edge portion 8*c* on the under side of the semicircular through-hole board 8, which has the semicylindrical through hole 8*a* formed in its peripheral surface, is mounted by soldering on the microcomputer mounting foot pattern 3*a*.

Namely, as shown in FIG. 3, the semicylindrical conductor 8*b* forming the through hole 8*a* in the semicircular through-hole board 8 is mounted on the foot pattern 3*a* and the semicircular lower edge portion 8*c* of the through hole 8*a* is soldered to the foot pattern 3*a*. The soldering, differing from the soldering of a pin terminal to the foot pattern 3 in the prior art example, can be simply achieved by just heating the lower edge portion 8*c* of the through hole 8a with solder applied to the edge portion. Thus, each of the semicylindrical conductors 8*b* can be electrically connected to each pattern of the foot pattern 3*a*.

Needless to say, it is not necessary to extend the pin terminal outward in a radiating manner and, therefore, the need for providing the foot pattern 3 longer than the pin terminal in the outside of the semicircular through-hole board 8 as with the prior art example can be eliminated so that, as long as there is provided only the very short foot pattern 3*a* in the outside of the semicircular through-hole board 8, the soldering can be achieved.

Accordingly, even if the area occupied by the microcomputer mounting foot pattern 3*a* and the area occupied by the semicircular through-hole board 8 are substantially equal, the soldering can be achieved and hence the packaging density on the user target board 1 can be increased.

Each of the semicylindrical conductors 8*b* is connected to each pin of the first connector of the relaying connector 9 mounted on the semicircular through-hole board 8 by means of a wiring pattern 8*e*.

Figure 4:
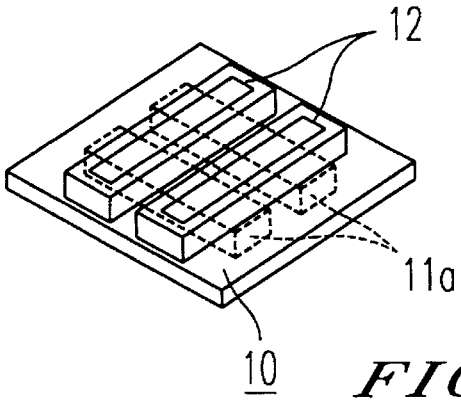
FIG. 4 is a perspective view showing a direction changing board 10 in the embodiment 1.

Then, the direction changing board 10 is attached to the relaying connector 9 mounted on the semicircular through-hole board 8 with the first connector 11*a* electrically coupled to the relaying connector 9. At this time, the first connector 11*a* and the second connector 12 set on the direction changing board 10 are differing in their directions of setting by 90 degrees as shown in FIG. 4. Further, each pin of the first connector 11*a* is connected in one-to-one correspondence with each pin of the second connector 12.

Therefore, when the emulator body is mounted by connecting the connector 16 of the cable setting board 15 to the second connector 12, the direction in which the emulator cable 6 is led out differs 90 degrees from the direction in the case where the connector 16 of the cable setting board 15 is directly coupled to the relaying connector 9 (the relaying connector 9 and the second connector 12 are of the same form). Accordingly, when there is disposed a tall part in the direction in which the emulator cable 6 is led out, the emulator body can be mounted on the user target board 1 easily without the need for deforming the emulator cable 6 by mounting the emulator body through the direction changing board 10.

Figure 7:
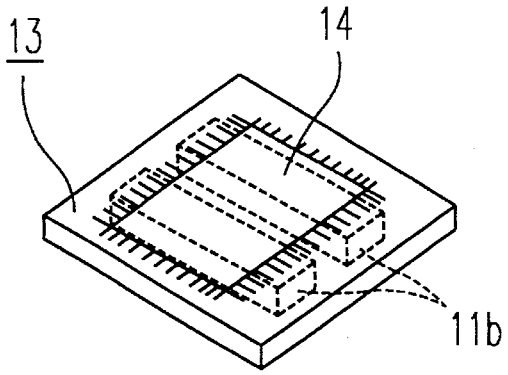
FIG. 7 is a perspective view showing a microcomputer mounting board 13 according to the invention.

As shown in FIG. 7, by attaching the microcomputer mounting board 13 to the relaying connector 9 in place of the direction changing board 10, the microcomputer 2 can be mounted on the user target board 1.

Embodiment 2

Figure 5:
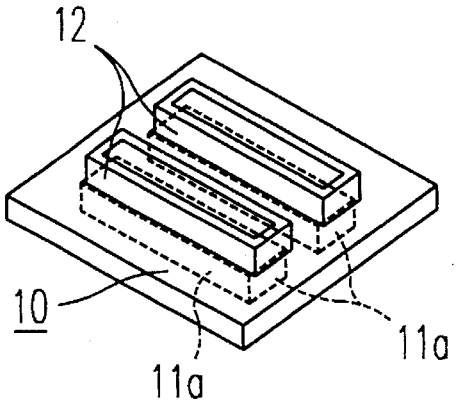
FIG. 5 is a perspective view showing a direction changing board 10 in an embodiment 2.

Although the case where the angle of setting of the first connector 11*a* differs 90 degrees from that of the second connector 12 was shown in the embodiment 1, the one may differ 180 degrees from the other as shown in FIG. 5 to obtain the same effect as obtained in the embodiment 1.

Embodiment 3

Figure 6:
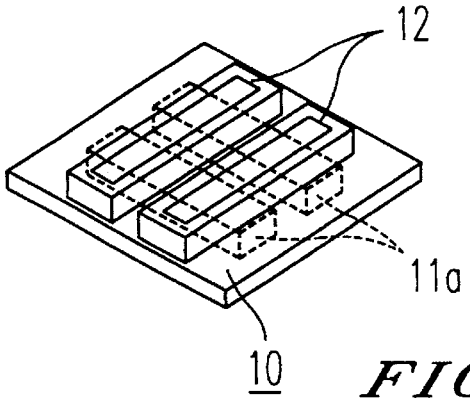
FIG. 6 is a perspective view showing a direction changing board 10 in an embodiment 3.

Although the case where the angle of setting of the first connector 11*a* differs 90 degrees from that of the second connector 12 was shown in the embodiment 1, the one may differ 270 degrees from the other as shown in FIG. 6 to obtain the same effect as obtained in the embodiment 1.

Embodiment 4

Although the cases where the angles of setting are fixed were shown in the embodiments 1 to 3 above, the angle of setting between the first connector 11*a* and the second connector 12 may of course be adapted to be suitably adjusted.

Embodiment 5

Although the cases where the embodiments were applied to the emulator probe for the emulator which provides support for program development of a microcomputer 2 were shown above, the embodiments can also be applied, for example, to the probe for the in-circuit emulator of a gate array.

From the foregoing description, it will be apparent that, according to the present invention, the emulator probe is provided with a direction changing board which has a first connector to be coupled with the relaying connector 9 set on one surface thereof and a second connector set on the other surface thereof such that the direction of setting of the same is different from the direction of setting of the first connector and, hence, the direction in which the emulator cable is led out is not limited to one. As a result, even if there is present a tall part in the direction in which the emulator cable is led out, the emulator body can be mounted on the user target board easily without deforming the emulator cable. Further, such a merit can be obtained that the direction changing board can be produced by other method than resin forming and hence it can be produced at low cost.

Further, since it is adapted such that soldering to the microcomputer mounting foot pattern is achieved not through a pin terminal but through the semicircular edge portion of the semicircular through hole formed in the peripheral surface of the semicircular through-hole board, the soldering can be achieved even if the area occupied by the microcomputer mounting foot pattern and the area occupied by the semicircular through-hole board are virtually equal and therefore the packaging density on the user target board can be increased.

What is claimed is:

1. An emulator probe comprising:

at least one semicylindrical conductor having a semicircular edge portion, soldered to a microcomputer mounting foot pattern, provided on a user target board and forming a semicylindrical through-hole;

a semicircular through-hole board having said semicylindrical conductor disposed on the peripheral surface thereof such that said semicircular through hole is formed as a recess in the peripheral surface;

a relaying connector having a terminal electrically connected with said semicylindrical conductor and disposed on said semicircular through-hole board;

a direction changing board having a first connector electrically coupled to said relaying connector and set on the under side thereof and having a second connector electrically connected with said first connector and set on the upper side thereof such that the direction of setting thereof differs from the direction of setting of said first connector; and cable setting board attached to the end of an emulator cable and having a connector electrically coupled to said second connector on said direction changing board.

2. An emulator probe according to claim 1, wherein said microcomputer, when said cable setting board of said emulator probe is not connected with said second connector on said direction changing board, is mounted on said semicircular through-hole board.

3. An emulator probe according to claim 1, wherein said semicylindrical conductor is produced by having a cylindrical conductor whose cross-section forms a circular through-hole cut in two along its center axis.

4. An emulator probe according to claim 1, wherein said relaying connector and said second connector on said direction changing board are of the same form.

* * * * *